US009702223B2

(12) United States Patent
Irmann-Jacobsen et al.

(10) Patent No.: US 9,702,223 B2
(45) Date of Patent: Jul. 11, 2017

(54) SUBSEA COOLER

(75) Inventors: Tine Irmann-Jacobsen, Hvalstad (NO); Brian Gyles, Asker (NO); Magnus Huse, Ålesund (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 855 days.

(21) Appl. No.: 13/384,144

(22) PCT Filed: Jun. 30, 2010

(86) PCT No.: PCT/NO2010/000252

§ 371 (c)(1),
(2), (4) Date: May 8, 2012

(87) PCT Pub. No.: WO2011/008101

PCT Pub. Date: Jan. 20, 2011

(65) Prior Publication Data

US 2012/0298343 A1 Nov. 29, 2012

(30) Foreign Application Priority Data

Jul. 15, 2009 (NO) ..... 20092684

(51) Int. Cl.

| | |
|---|---|
| ***F28F 9/02*** | (2006.01) |
| ***E21B 36/00*** | (2006.01) |
| ***F28D 1/02*** | (2006.01) |
| ***F28D 1/047*** | (2006.01) |

(52) U.S. Cl.
CPC ..... *E21B 36/001* (2013.01); *F28D 1/022* (2013.01); *F28D 1/0477* (2013.01)

(58) Field of Classification Search
CPC ... F28F 9/0224; Y02E 60/142; F28D 20/0052
USPC ..... 165/173, 45, 165, 150, 175
See application file for complete search history.

(56) References Cited

U.S. PATENT DOCUMENTS

| | | | | | |
|---|---|---|---|---|---|
| 2,138,777 | A | * | 11/1938 | Zellhoefer | F25B 39/02 165/150 |
| 2,994,724 | A | * | 8/1961 | Segura et al. | 585/354 |
| 3,581,475 | A | | 6/1971 | Sauder | |
| 3,750,248 | A | | 8/1973 | Morris | |
| 4,290,417 | A | * | 9/1981 | Peters | F24J 2/44 126/586 |
| 4,499,055 | A | * | 2/1985 | DiNicolantonio | C10G 9/20 165/163 |
| 4,551,181 | A | * | 11/1985 | Stearman | F28G 9/00 134/22.11 |
| 4,573,911 | A | | 3/1986 | Kimmich | |

(Continued)

FOREIGN PATENT DOCUMENTS

| | | | |
|---|---|---|---|
| RU | 1774148 | A1 | 11/1992 |
| SU | 1721426 | A1 | 8/1989 |

(Continued)

*Primary Examiner* — Len Tran
*Assistant Examiner* — Claire Rojohn, III

(57) ABSTRACT

The present invention regards a subsea cooling unit comprising a first header pipe (48), a second header pipe (46) having its longitudinal axis substantially parallel with and in a distance from the first header pipe, and arranged between the first and second header pipe, at least one set of cooler coils (400); where the at least one set is formed such that the coils of the one set is arranged in one plane.

4 Claims, 6 Drawing Sheets

(56) References Cited

U.S. PATENT DOCUMENTS 4,814,044 A * 3/1989 Hitt ..... B01D 1/04 137/202
4,901,791 A * 2/1990 Kadle ..... F25B 39/04 165/150
4,914,255 A * 4/1990 Avidan ..... B01J 8/1836 165/104.13
5,179,845 A * 1/1993 Sasaki ..... B60H 1/3227 165/150
5,224,537 A * 7/1993 Potier ..... F28D 1/0475 165/149
5,368,097 A * 11/1994 Chiba ..... B60H 1/3227 165/150
6,142,215 A * 11/2000 Paulsen ..... F28D 1/0213 165/128
6,591,627 B1 * 7/2003 Rollins ..... F24F 1/027 165/173
7,320,178 B2 * 1/2008 Kirby ..... B22D 19/0072 148/594
7,384,539 B2 * 6/2008 Witte ..... B01J 19/0013 165/172
7,779,898 B2 * 8/2010 Morrison ..... F28C 1/14 165/150
2001/0040024 A1 * 11/2001 Blanda, Jr. ..... C01C 3/022 165/134.1
2002/0062953 A1 * 5/2002 Demuth ..... F28D 1/0478 165/173
2006/0048929 A1 * 3/2006 Aaron ..... F28D 7/08 165/173
2006/0254752 A1 11/2006 Narakino et al.
2008/0060786 A1 * 3/2008 Warnelov et al. ..... 165/45
2008/0302511 A1 * 12/2008 Kragt ..... F28D 7/16 165/95
2009/0277612 A1 * 11/2009 Poorte ..... E21B 36/001 165/104.21
2009/0314481 A1 * 12/2009 Poorte ..... F28D 1/022 165/184
2010/0186929 A1 * 7/2010 Chantant ..... F25B 9/006 165/104.21
2010/0252227 A1 * 10/2010 Sten-Halvorsen .... E21B 36/001 165/45
2010/0258265 A1 * 10/2010 Karanikas ..... E21B 43/243 165/45
2012/0097362 A1 * 4/2012 Kanstad ..... E21B 36/001 165/45
2012/0180502 A1 * 7/2012 Morris ..... F17C 11/007 62/47.1
2012/0255706 A1 * 10/2012 Tadayon ..... F24J 3/081 165/47
2012/0285656 A1 * 11/2012 Moore ..... F25J 1/0022 165/45
2013/0056190 A1 * 3/2013 Bromberg ..... F28F 3/14 165/173
2014/0020876 A1 * 1/2014 Rolland ..... F28F 13/12 165/165
2014/0209279 A1 * 7/2014 Aaron ..... F28B 1/06 165/104.13
2014/0246166 A1 * 9/2014 Kaasa ..... E21B 36/001 165/45
2014/0262167 A1 * 9/2014 Kuo ..... F28F 9/0132 165/133
2016/0341481 A1 * 11/2016 Freund ..... F28D 1/0477

FOREIGN PATENT DOCUMENTS

WO WO 2008/004886 A1 1/2008
WO WO 2008004886 A1 * 1/2008 ..... F28D 1/053
WO WO 2008/147219 A2 12/2008
WO WO 2008147219 A2 * 12/2008 ..... E21B 36/00

* cited by examiner

SUBSEA COOLER

BACKGROUND OF THE INVENTION

The present invention regards a subsea cooling unit.

Coolers in general are of course well known in the art, for example as radiators in automobiles and refrigerator systems. One example of a representative cooler is shown in GB 2145806 which shows a stack of serpentine coils used in a cooler for a refrigerator. Another example of a cooling system is described in WO 2009/046566 which shows a cooling unit being assembled from bends and straight pieces of stainless steel. There are also known subsea coolers, on example is WO2008/004885, which describes a lightweight underwater cooling assembly.

It is well known that a compressor's function is in part dependent upon the temperature of the medium that shall be compressed, and it has been shown that cooling the medium increases the efficiency of the compressor. In a subsea environment it is especially important because of the remoteness and difficult access to a subsea installation which creates the need for efficient cooling as this leads to savings in the compressor. Add to this the remoteness which creates its own challenges for reliability and fault-free running. However, cooling a hydrocarbon well stream may create other problems since there usually is entrenched water in the well stream and cooling enables water to be separated out as free water and this may lead to hydrate formation. It is therefore important that a subsea cooling unit is well adapted to the specific use and amount and composition of the medium to be cooled.

There is therefore a need for a cooler which is easy assembled and adaptable for the specific use subsea, to achieve the necessary cooling.

A cooling unit as defined in the attached claims provides a solution to this need.

SUMMARY OF THE INVENTION

According to the invention there is provided a subsea cooling unit comprising a first header pipe, a second header pipe having its longitudinal axis substantially parallel with and in a distance from the first header pipe, and arranged between the first and second header pipe, at least one set of cooler coils; where the at least one set is formed such that the coils are arranged in one plane. The first header pipe is adapted for communication with at least one hydrocarbon well and forming a common inlet for the subsea cooling unit. The second header pipe is adapted for communication with a flow line and forming a common outlet for the subsea cooling unit. Each set of cooler coils is individually connected to both the header pipes.

These header pipes are as said adapted to be connected to processing equipment subsea and forms an inlet and outlet of the subsea cooling unit. The cooling unit may be used to cool a medium with for instance seawater. The medium to be cooled may then be guided within the header pipes and the coils, to be cooled with seawater on the outside of the pipes.

The length of the flow path in a set of cooler coils may easily be adapted. The number of sets of cooler coils may also easily be adapted. This gives a cooling unit which easily may be adapted for the specific use and desired cooling effect needed at a specific location. By having the coils run in one plane, several sets may easily be stacked next to each other. By this it is easy to adapt the cooling effect by adding or reducing the number of sets arranged between and in direct communication with both the header pipes and at the same time possibly adjusting the length of the header pipes to accommodate the needed number of sets of cooler coils. The cooling effect of the cooling unit may possibly also be altered during the life time of the cooling unit, by having the header pipes configured such that they may receive additional sets of cooler coils during the life time of the cooling unit.

According to another aspect the header pipes have longitudinal axes arranged mainly in parallel, and a plane wherein the coils of one set is arranged, may be arranged transverse to the longitudinal axes of the header pipes. If the longitudinal axis of one header pipe forms an X-axis of a coordinate system, the longitudinal axis of the two header pipes are arranged in a plane with both the X- and Y-axes and a Z-axis transverse to this X/Y-plane to form the coordinate system. The plane of the cooler coils may then be arranged parallel with the Z-axis and Y-axis and transverse to the X-axis. Alternatively the plane of the cooler coils may be arranged inclined in relation to the X- and Y-axes and parallel to the Z-axis. Alternatively the plane of the cooler coils may be arranged inclined in relation to the Z- and X-axes and parallel to the Y-axis. Alternatively the cooler coils may be arranged inclined in relation to all three axes.

According to another aspect of the cooling unit it may comprise several sets connected to the header pipes, where the sets may be arranged with their main plane of the coils in parallel.

The pipes used for the cooling coils have a nominal diameter D. The term "nominal diameter" is a well known term for those skilled in the art, and one example for such nominal diameters is given in the ANSI B.36.19 standard. According to another aspect the pipes forming the coils of one set may have a nominal diameter D, where D may be from 1 to 2 inches (2.54 cm to 5.08 cm), preferably 1.5 inches (3.81 cm).

According to yet another aspect of the invention the at least one set of cooler coils form a serpentine configuration and may comprise at least three straight pipes and at least two 180 degrees bends, where the straight pipes and the bends are arranged to form continuous coils forming an internal flow path and two connectors, one at each end of the flow path for connection of the set of cooler coils to the header pipes. The straight pipes and the bends are preferably prefabricated standard units. The assembly of the straight pipes and the bends will then form a serpentine flow path. By assembly of a number of these one may adapt the set of cooler coils to the length necessary for the specific use, which gives great versatility of the cooling unit. The standardization of the elements forming the cooling unit also makes it inexpensive and easily adaptable.

In a further aspect the set may be formed with a pipe diameter D, the bends with a radius R, and a distance S between each of the straight pipes having a length L, where R may be between 3.1D and 1.9D.

In still another aspect the set may be formed with a pipe diameter D, the bends with a radius R, and a distance S between each of the straight pipes having a length L, where S may be between 3.0D and 4.0D.

In still another aspect the set may be formed with a pipe diameter D, the bends with a radius R, and a distance S between each of the straight pipes having a length L, where L advantageously may be between 20D and 35D, preferably 30D According to another aspect the cooling unit may comprise several sets, where the distance between the straight pipes in neighboring sets may be between 3.0D and 4.0D, where D is the diameter of the pipes.

There may also be a cooling unit with some or all of the above mentioned aspects.

The present invention also regards a method for manufacturing a subsea cooler comprising the steps of preparing a number of identical straight pipes and bends, assembling the straights and bends in a serpentine configuration and formed in one plane, and attaching a connector at each end of the assembly, preparing other identical assemblies and connecting each assembly to first and second header pipes, resulting in a modular cooling unit. According to one aspect the pipes are welded together. According to another aspect of the invention the assembly is formed with at least three straight pipes and at least two 180 degrees bends.

BRIEF DESCRIPTION OF THE DRAWINGS

The invention will now be explained with non-limiting embodiments with reference to the attached drawings, where.

DETAILED DESCRIPTION OF THE INVENTION

Figure 1:
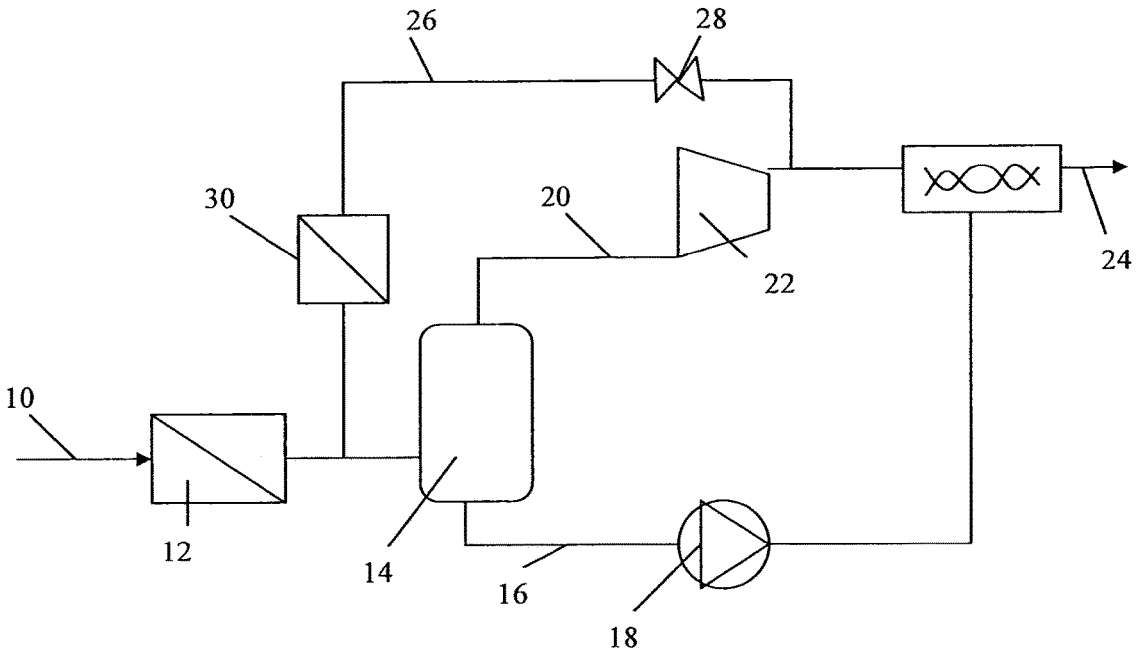
FIG. 1 show a standard gas compression layout.

Reference is first made to FIG. 1 which shows a standard subsea gas compression layout. A flow line 10 bearing well hydrocarbons from one or more wells (not shown) passes through cooler 12 into a scrubber 14. In the scrubber liquids (i.e. water and oil) are separated from the gas and the liquid is passed through line 16 and is boosted by pump 18. The gas passes through line 20 to a gas compressor 22. Gas and liquids are recombined into an export flow line 24 to a receiving facility which may be located in an offshore platform or onshore. An anti-surge loop 26 is arranged to recycle gas back into the separator. In the anti-surge loop there is provided a special valve (anti-surge valve) 28 and a second cooler 30. The second cooler is arranged to cool down gas that has been heated by going through the compressor.

Figure 2:
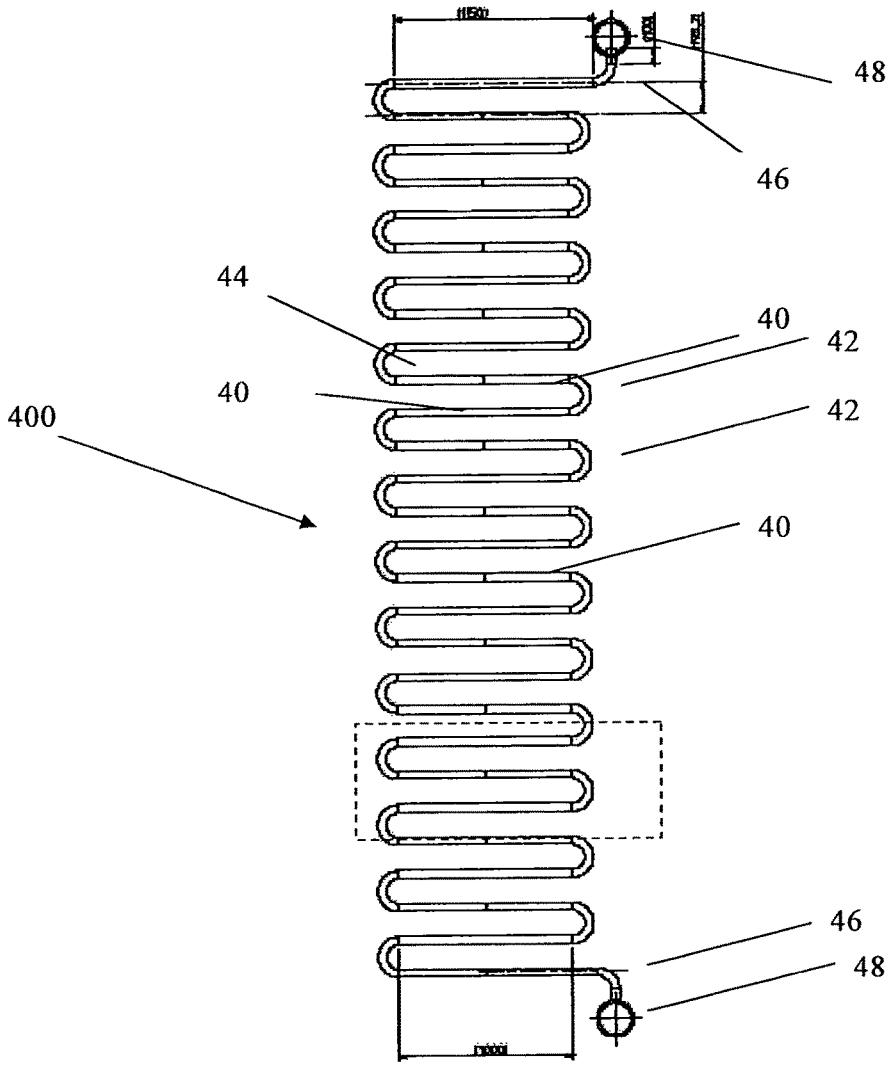
FIG. 2 show one set of cooling coils.
Figure 2B:
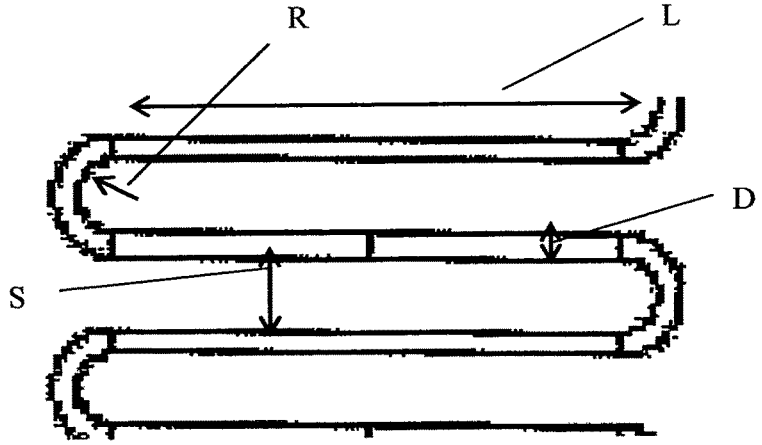
FIG. 2*b* shows a detail of FIG. 2
Figure 3:
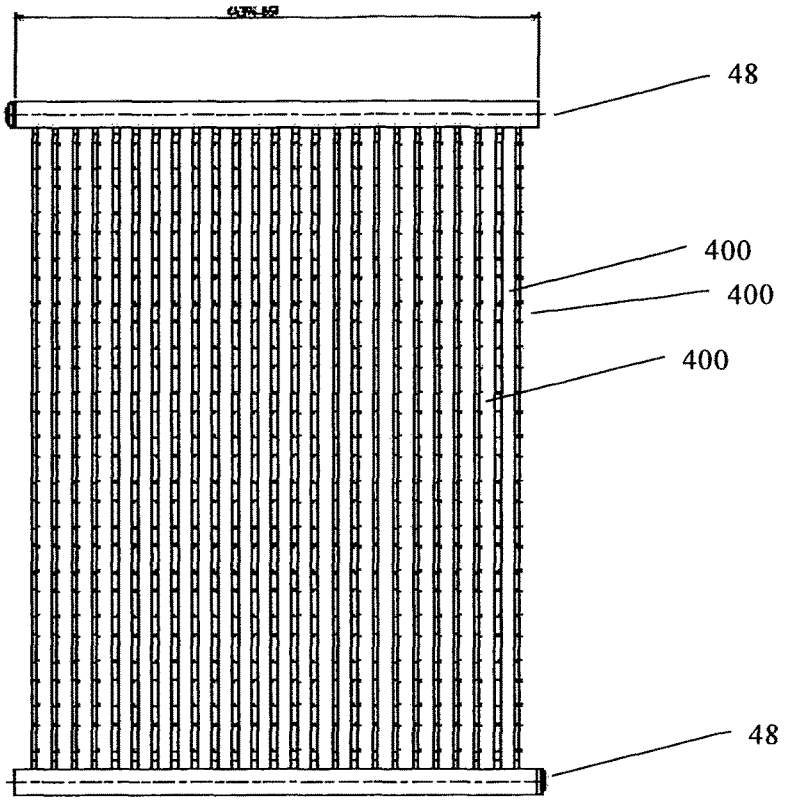
FIG. 3 is a side view of a cooling unit according to the invention.
Figure 4:
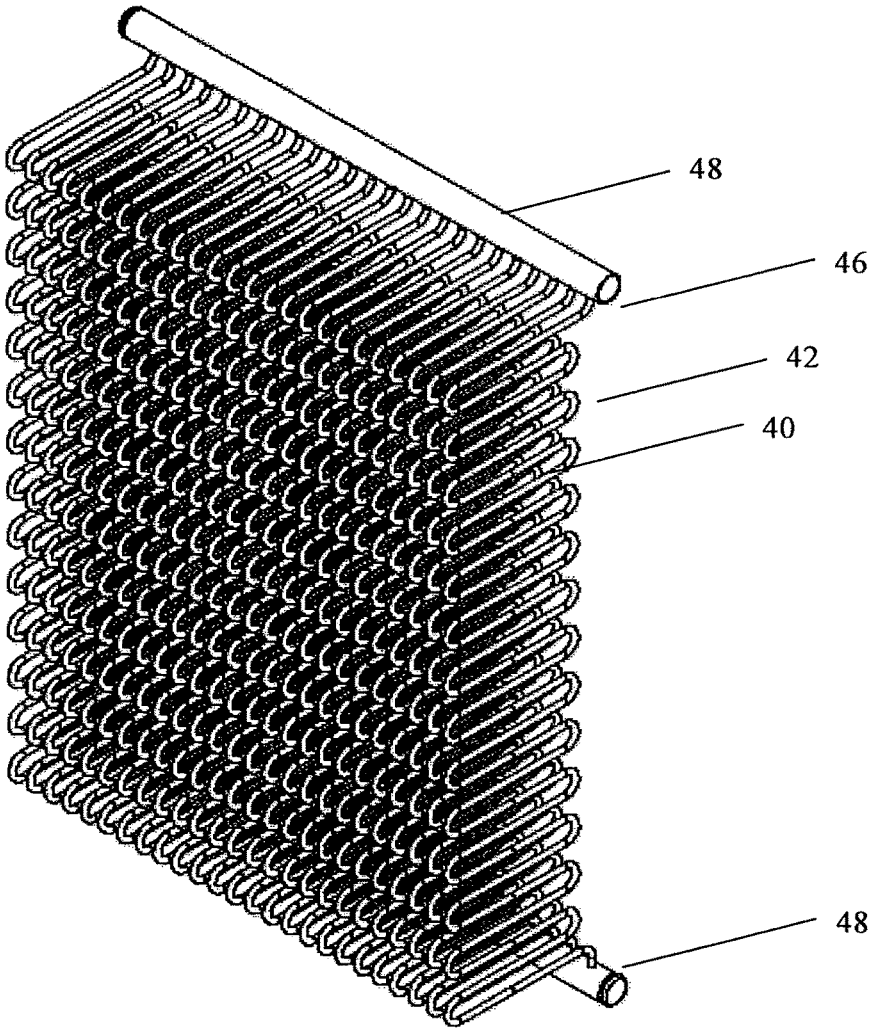
FIG. 4 is the unit on FIG. 3 seen elevated.

The cooler as shown in FIG. 3 consists of a number of identical standard modules or said with other words a set of cooler coils 400 that will be assembled as shown to form the cooler assembly. A cooler module or set 400 is shown in FIG. 2. The cooler module is in the form of a coil comprising a number of straight pipes 40 connected with alternating 180° bends 42 and 44. Pipes 40 and bends 42, 44 all lay within the same plane in the shown embodiment. At each end of the flow path formed by the straight pipes 40 and the bends 42,44, there are connector 46, 48 for fluid connection with a header pipe 50, 52 (FIG. 3). The pipes 40, bends 42,44 and connectors 46,48 form an internal flow path through the set or cooler module 400.

Fluid from the flow line 10 enters the header 48 and flows through pipe 40 to the other header 46. The headers are used for distributing fluid evenly to each module. The modular design enables the assembly of the number of identical modules according to the flow and the cooling requirements. As can be seen from FIG. 3 each cooler module is assembled with the headers to create the cooler assembly.

The cooler module has the pipes arranged in a plane, with the straights and bends all having axes that fall within the plane. This makes it easy to stack the modules in parallel as shown in FIG. 3. This results in an efficient stack up to maximize the cooling effect.

The pipe has diameter D, which preferably is between 1 and 2 inches (2.5 to 5 cm). In a preferred embodiment the pipe has a nominal diameter of 1.5 inch schedule 40 (ANSI B36,19) which will then have an outer diameter of 48.3 millimeters. The length of each straight section is L, that for example may be 1 meter. The bends have a radius R. The distance between the straight pipes as measured from the axis is S. We have found that the most efficiency gain can be found when R is smaller than 3.1D but larger than 1.9D and S is smaller than 4.0D but larger than 3.0D. The distance between each module (as measured between the planes) may preferably be the same as the distance S.

Figure 5A:
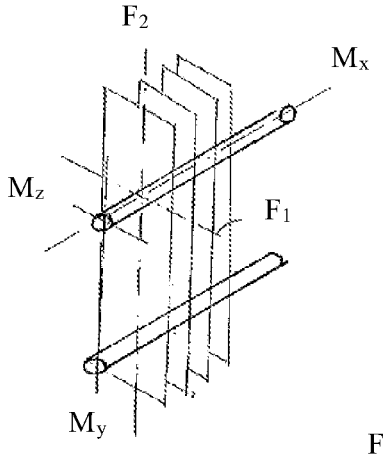
FIGS. 5*a* to 5*d* are principle sketches of the orientation of the cooling coils relative the header pipes.
Figure 5B:
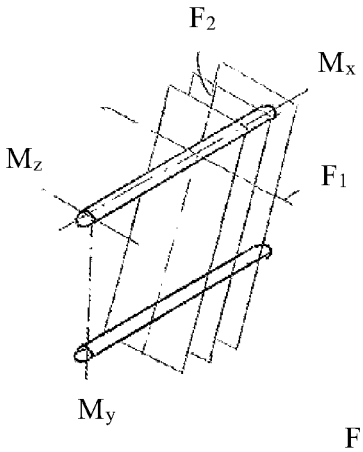
Figure 5C:
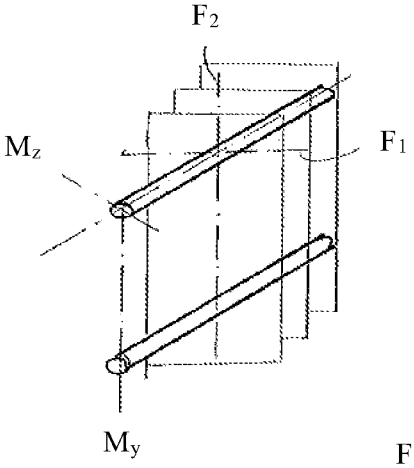
Figure 5D:
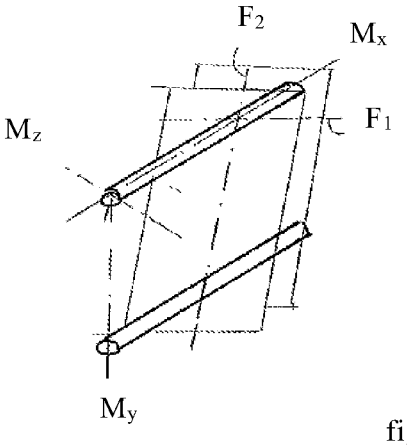

In FIGS. 5*a* to 5*d* there are shown different configurations of the orientation of the set of cooler coils or modules in relation to the header pipes. In FIG. 5*a* a plane of the set of cooler coils, as indicated by P1-P4 are arranged transverse to a longitudinal axis Mx a the header pipe. This longitudinal axis of the header pipe Mx, forms an X-axis in an imaginary coordinate system. The header pipes both have a longitudinal axis which will be in an imaginary XY-plane, and a Z-axis will be transverse to this XY-plane. The plane of the cooler coils in FIG. 5*a* is thereby parallel to both the Z-axis and the Y-axis. In FIG. 5*b* the plane of the cooler coils are reoriented compared with FIG. 5*a*. The planes P1-P3 of the cooler coils is parallel to the Z-axis but forms an angle in relation to both the X- and Y-axes. The plane is thereby inclined in one direction. In FIG. 5*c* the planes P1-P3 are again reoriented, to be inclined in one direction but twisted in comparison with FIG. 5*b*. In FIG. 5*c* the planes are parallel with the Y-axis and inclined in relation to the X-axis and the Z-axis. In FIG. 5*d* there is shown yet anther configuration where the planes P1-P2 are given both the inclinations as shown in FIG. 5*b* and FIG. 5*c*, and thereby is inclined in relation to all three axes.

Figure 6A:
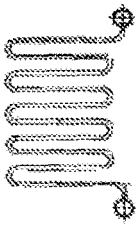
FIG. 6*a*-6*c* and FIG. 7 are different embodiment of a set of cooling coils.
Figure 6B:
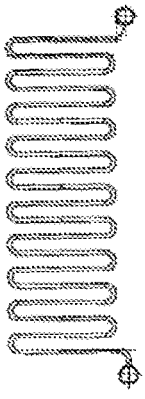
Figure 6C:
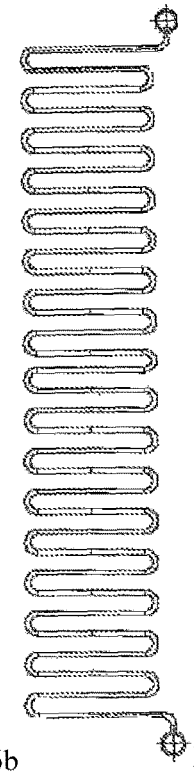
Figure 7:
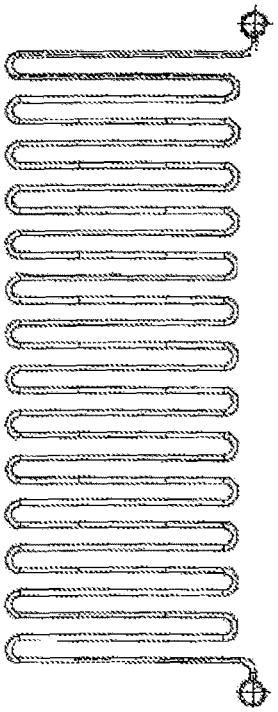

In FIGS. 6*a* to 6*b* there are shown different embodiments of a cooler coils set. In FIG. 6*a*, the set is formed with nine bends and ten straight pipes. In FIG. 6*b* there are twenty straight pipes, and in FIG. 6*c* there are thirty-four straight pipes. In FIG. 7 there is shown an embodiment of a cooler coils set where the length of the twenty-eight straight pipes are longer than in the embodiment shown in FIG. 6. There are only shown cooler coil sets with an even number of straight pipes, but there may also be uneven numbers if the header pipes are arranged shifted and not on one side of the cooler coils set. This shows that the cooler coils set may be adapted to the specific use, by adapting the length of the cooler coils. When it is said that the cooler coils set is comprised of bends and straight pipes, a unit for assembly of the cooler coils set according to the invention may as an alternative to being a unit in the form of a bend and in addition another unit in the form of a straight pipes, be a unit comprising a bend and at least a part of a straight pipe. One possible embodiment of this solution is to have all units equal, where each unit is forming a bend and one straight pipe, or where each unit is forming a bend and parts of two straight pipes. Such a configuration will possibly lead to less assembly joints compared to a system assembled from separate bends and straight pipes as explained earlier. This will again for instance mean less welding to assemble the cooling unit.

The design offers a number of advantages not seen in prior art designs. Firstly, the number of bends and straights can be tailored to the space available, e.g. height. Secondly the modules can be stacked together in a frame to give the compact design. The final size will be determined by the flow rate and the cooling efficiency. The design also results in an easier and more efficient way of producing the assembly and enables an optimum cathodic protection arrangement as the elements forming the subsea cooler are standard unit elements, the cathodic protection may also be standardized.

A special advantage of the invention is that since all the parts (bends and straights) are standardized the parts can be manufactured in bulk and then assembled e.g. welded together in the configuration most suited to the physical characteristics of the well fluids and the desired cooling effect. The end result is a more efficient and therefore cheaper manufacture of the cooler.

The invention has now been explained with one embodiment. A skilled person will understand that there may be made alternations and modifications to the described embodiment which are within the scope of the invention as defined in the attached claims.

The invention claimed is:

1. A subsea well fluid cooling unit comprising:

a first header pipe adapted for communication with at least one hydrocarbon well and forming a common inlet;

a second header pipe adapted for communication with a flow line and forming a common outlet, the second header pipe being substantially parallel with and positioned at a distance from the first header pipe; and several sets of cooler coils arranged between the first and second header pipes, said several sets of cooler coils being stacked together in a frame;

wherein each set of cooler coils is individually connected to the first and second header pipes;

wherein at least one set of cooler coils comprises at least three straight pipes, at least two 180 degree bends and two connectors for connection of the set to the first and second header pipes;

wherein the first and second header pipes define a first plane, each set of cooler coils extends in a respective second plane which is perpendicular to the first plane, and the sets of cooler coils are arranged such that the second planes are parallel to each other; and wherein the straight pipes and the bends have a constant diameter D of from 1 inch to 2 inches, the straight pipes have a length L of between 20D and 35D, the bends have a radius R of between 1.9D and 3.1D, the straight pipes are located a distance S from each other of between 3.0D and 4.0D, and the distance between the planes of adjacent sets of cooler coils is between 3.0D and 4.0D;

whereby well fluid flowing through the cooler coils between the first and second header pipes is cooled by ambient seawater.

2. Subsea cooling unit according to claim 1, wherein the plane of the coils of at least one set is arranged transverse to the longitudinal axes of the header pipes.

3. The subsea well fluid cooling unit according to claim 1, wherein the straight pipes and the bends have a diameter D of 1.5 inches.

4. The subsea well fluid cooling unit according to claim 1, wherein the straight pipes have a length L of 30D.

* * * * *